United States Patent [19]

Klees

[11] 4,232,875

[45] Nov. 11, 1980

[54] SKI POLE GRIP WITH SELF HINGE FOR IMPROVED FORWARD REACH

[76] Inventor: Garry W. Klees, 9130 SE. 72nd Pl., Mercer Island, Wash. 98040

[21] Appl. No.: 7,046

[22] Filed: Jan. 29, 1979

[51] Int. Cl.[3] ..... A63C 11/22

[52] U.S. Cl. ..... 280/822; 222/55

[58] Field of Search ..... 280/11.37 B, 11.37 D, 280/11.37 H, 11.37 L, 11.37 E; 224/52, 55, 58

[56] References Cited

U.S. PATENT DOCUMENTS

| | | | |
|---|---|---|---|
| 3,113,786 | 12/1963 | Phillipson | 280/11.37 H |
| 3,923,317 | 12/1975 | Penney | 280/11.37 H |
| 4,004,818 | 1/1977 | Ramillon | 280/11.37 H |
| 4,005,872 | 2/1977 | Rischert et al. | 280/11.37 H |

FOREIGN PATENT DOCUMENTS

| | | | |
|---|---|---|---|
| 562041 | 5/1975 | Switzerland | 280/11.37 H |

*Primary Examiner*—John J. Love
*Assistant Examiner*—Michael Mar
*Attorney, Agent, or Firm*—David L. Garrison

[57] ABSTRACT

A handle or grip for a ski pole comprising a body adapted to be grasped by the hand and having a means encircling the back of the hand of the user which means is resiliently mounted to the grip and extends downwardly within the grasp of the user, then around the back of the user's hand or wrist. The hand encircling portion is free at its upper end to deflect outwardly at the top of the grip to effect release from the user's hand. The resilient mount permits improved forward reach during use of the ski pole.

8 Claims, 10 Drawing Figures

SKI POLE GRIP WITH SELF HINGE FOR IMPROVED FORWARD REACH

BACKGROUND OF THE INVENTION

This invention relates to the handle or grip for a ski pole and, particularly, to such a grip having a hand encircling, releasable retainer means.

The usual apparatus engagement of the ski pole with the skier's wrist is a leather or other similar material wrist strap attached to the top of the ski pole handle. The strap forms a loop that encircles the wrist and is difficult to remove from the wrist. Serious injuries have occurred when the basket of the ski pole has become entangled in ski tow mechanisms or hooked upon trees, bushes or rocks. The traditional wrist-type strap is dangerous, inconvenient to use, and the source of annoyance to skiers.

One improvement in the wrist strap type of grip is shown in the U.S. Pat. No. 3,479,045 issued Nov. 18, 1969 to Earl A. Miller. This reference shows of the ski pole grip to aid the skier in using the ski poles and to retain the ski pole handles upon the skier's hand. While this structure avoids the disadvantages of the prior wrist encircling strap of the ski pole grips, the Miller grip permits the ski pole to become disengaged from the hand too easily and the pole, consequently, is easily lost by the skier. In addition the skier is unable to obtain the full forward reach capabilities desirable for alpine skiing techniques.

OBJECTS OF THE INVENTION

It is one object of this invention to provide a ski pole handle having a resilient hand encircling loop formed to the contour of the skier's hand which loop is attached at one end only, permitting removal of the skier's hand without difficulty yet retaining the grip in engagement with the skier's hand under normal conditions.

It is the second object of this invention to provide a ski pole grip having a wrist encircling strap which is resiliently hinged at or near the top of the ski pole handle end which extends downwardly along the grip; thence around the hand of the user whereby a self-hinged structure, sometimes called a "flexure," is provided permitting advantageous forward reaching capabilities by the skier.

These and other objects of this invention become apparent from an examination of the appended drawings and the following description.

SUMMARY OF THE INVENTION

A ski pole grip is provided which has a hand encircling resilient retainer member attached at a hinge or flexure positioned preferably at or near the top of the ski pole grip and including a downwardly extending leg normally substantially parallel to and adjacent the shaft of the grip with a loop extending around the hand or wrist of the user having no point of attachment for the outer portion of the hand encircling member at the top of the grip. This structure permits the user to manipulate the ski pole handle securely in normal fashion yet permits the removal of the grip from the hand by a single manipulative step of pward movement of the skier's hand while holding the shaft of the pole stationary. A unique "self-hinge" or flexure point is provided by the integral molding of the grip whereby the downwardly depending leg of the hand encircling member can be flexed or resiliently angled outwardly from the grip of the pole while the hand encircling member retains its position about the user's hand, permitting the pole to rotate into the maximum forward reach position. Then as the tip of the pole is planted for a turning maneuver and drawn towards the skier, the "self-hinge" or flexure point resiliently urges the downwardly depending leg toward a position parallel with the pole shaft.

The ski pole grip of this invention is preferably molded in a single piece with the hinge point of the hand encircling strap positioned near the upper end of the pole handle. The downwardly extending leg of the hand encircling loop is grasped withethe handle by the user's hand with the hand encircling loop passing around the skier's hand, the unattached upper portion of the loop nestling against or near the upper end of the grip. An alternative structure wherein the hand or wrist encircling means is removably attached to the grip is also disclosed herein.

THE DRAWINGS

DETAILED DESCRIPTION OF PREFERRED EMBODIMENTS

Figure 1:
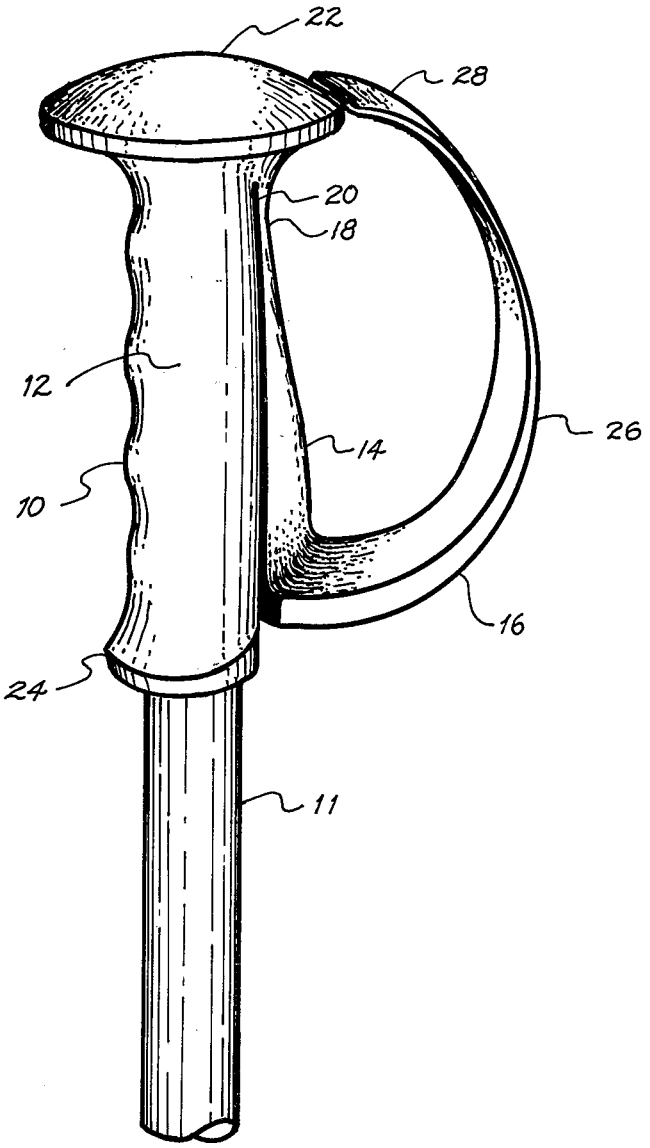
FIG. 1 is a perspective view of the ski pole handle grip of this invention.

Referring specifically to the drawings wherein like numerials indicate like parts, there is seen in FIG. 1 a molded ski grip handle 10 shown mounted upon ski pole 11. The grip portion 12 is designed so that a skier may grasp the grip 10 with his fingers encircling the grip 12 as well as the depending leg 14 of loop 16. Loop 15 is designed to encircle the wrist or back of the hand of the user to enable the user to manipulate the ski pole in the traditional fashion yet act as a safety device to retain the pole on the hand of the user under normal circumstances. Loop 16 comprises a depending leg 14, extending along and substantially parallel to the body 12 of the grip, and the hand or wrist encircling element 26.

Element 26 extends outwardly from the bottom end of leg 14 and upwardly towards the enlarged upper knob 22 in a configuration which permits the skier to insert his hand within the loop and grasp handle 10 and leg 14 with the element 26 wrapped about the back of the hand. The distal portion 28 of loop 16 is adjacent but not connected to upper knob 22. This configuration permits substantially enhanced forward reach with the pole in use due to the location of hinge point 20. Loop 16 is attached as its upper end 18 at hinge point 20 to the main body of grip 12. An enlarged upper knob 22 and enlarged portion 24 define the body area of the grip and enhance usage of the device by preventing the pole from sliding axially within the skier's grasp. The hand encircling portion 26 of the loop 16 bears lightly upon the back side of the user's wrist or hand to restrain the grip from being lost by the skier. The distal portion 28 of loop 16 nestles against the upper portion 22 of the grip 10 but is not attached thereto so that the flexible loop may be flexed outwardly thus releasing the grip from the hand of the user. The resilient nature of loop 16 tends to hold the grip in the hand while permitting removal of the grip from the hand without undue force.

Figure 3:
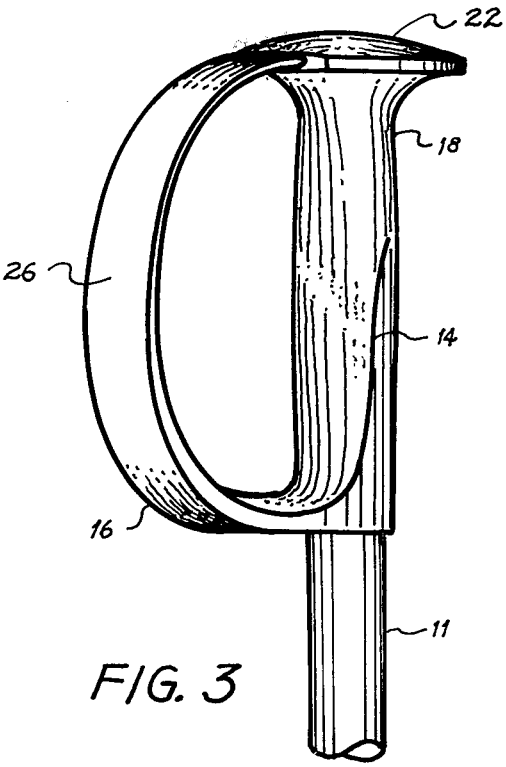
FIG. 3 is a side elevational view of the apparatus shown in FIG. 1.
Figure 4:
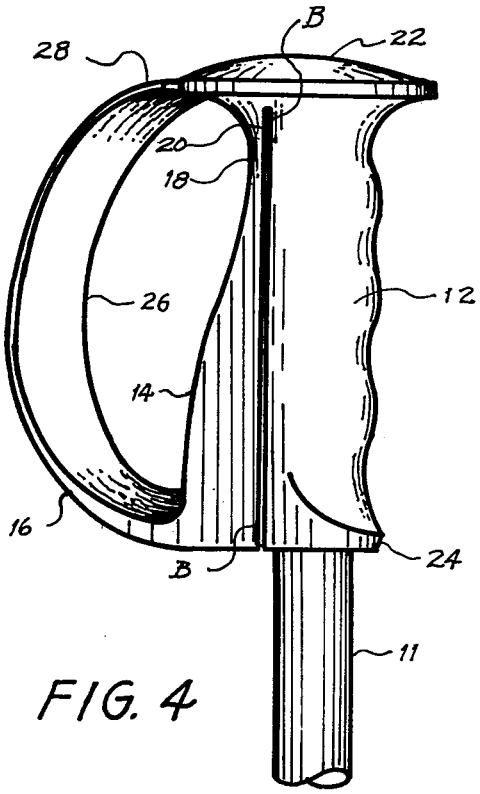
FIG. 4 is a second side elevational view of the apparatus shown in FIG. 1. taken in a direction substantially perpendicular to the view shown in FIG. 3.
Figure 7:
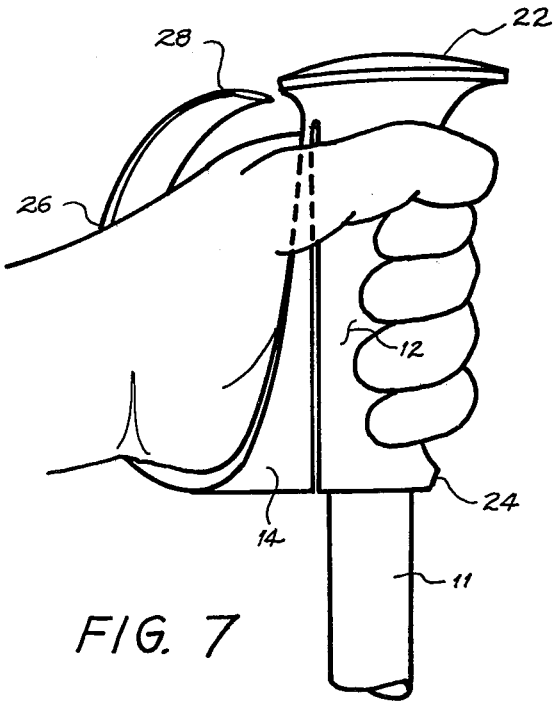
FIG. 7 is a side elevational view of the apparatus of FIG. 1. in usage.
Figure 8:
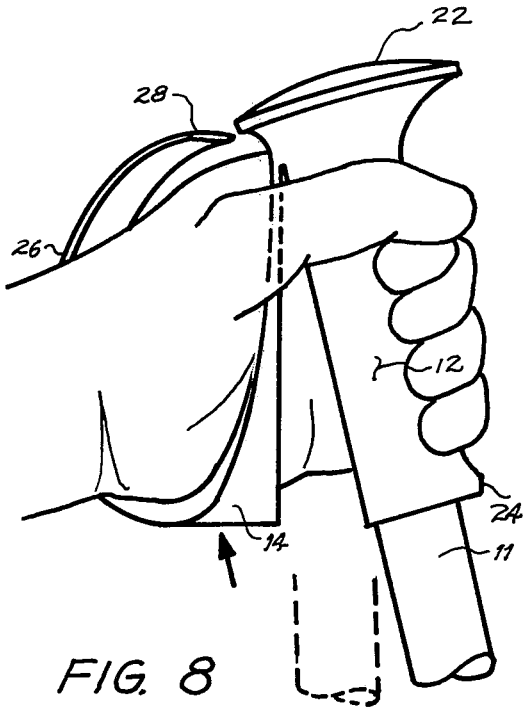
FIG. 8 is a side elevational view of the apparatus shown in FIG. 7 demonstrating pole reach.

The slot formed between the body 12 of the grip 10 and the depending leg 14 of loop 16 normally assumes the position as best shown in FIGS. 1 and 4 but may in use permit extension forwardly of the pole as best seen in FIG. 8. Thus hinge 20 is formed as an integral part of the grip at the time of molding of the device and is actually a flexure which is designed thin at the point of desired hinge-action. The device shown in FIGS. 1 thru 4, 7 and 8 is preferably molded as a single piece from an elastomeric material such as high density polyethelene, nylon, polyvinyl chloride, or other equivalent, well known injection molding resins, which have sufficient strength characteristics and resiliency to permit the grip to perform as described above.

Figure 5:
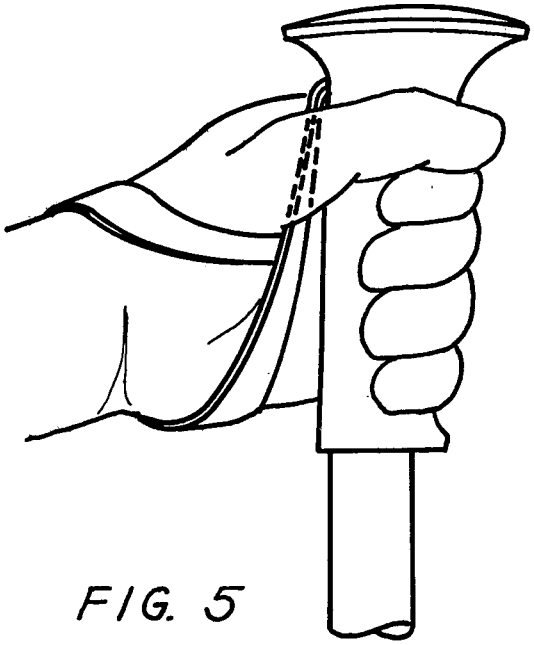
FIG. 5 is a side elevational view of a prior art device.
Figure 6:
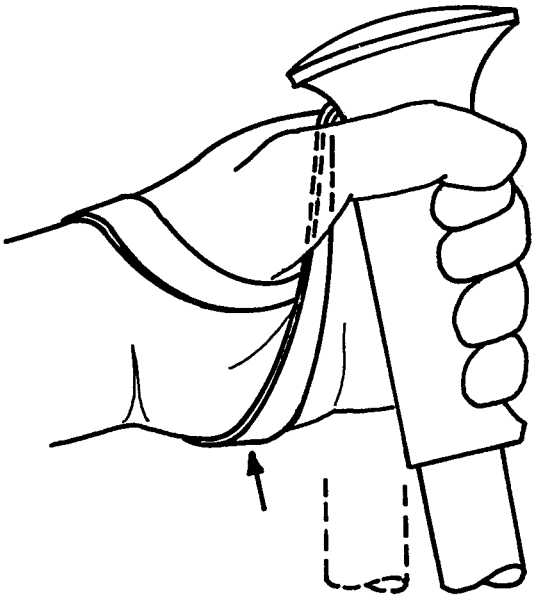
FIG. 6 is a side elevational view of the apparatus shown in FIG. 5 demonstrating pole reach.

In FIGS. 5 and 6, the usual, well known prior art consisting of a grip body which is encircled by the user's hand and fingers and a top mounted leather strap encircling the wrist, are shown, demonstrating the desirable forward reach capabilities needed by the skier to properly perform alpine skiing. The normal position is shown in FIG. 5 with the pole vertical. The forward reach of the pole permitted by the prior art structure shown is demonstrated in FIG. 6, and it also shows the major line of force indicated by the arrow which is being taken on the heel of the hand. This is a desirable loading situation since this produces minimum torque on the user's wrist, and minimum force on the user's fingers. Corresponding views of the device of this invention are shown in FIG. 7 and 8 in which the normal position with the ski pole in the vertical orientation as shown in FIG. 7 with the forward reach capabilities of the applicant's structure shown in FIG. 8. Note the hinging forward motion of the pole shown in FIG. 8 with the hand or wrist encircling portion 26 of the grip maintaining its essentially stationary position relative to the hand whereby the downwardly depending leg 14 assumes a non-parallel angular relationship with pole 11. The pole planting force, represented by the arrow, is also taken on the heel of the hand which is supported by a portion of the loop formed in a relatively rigid structure by increasing the thickness of the loop in this area.

Figure 9:
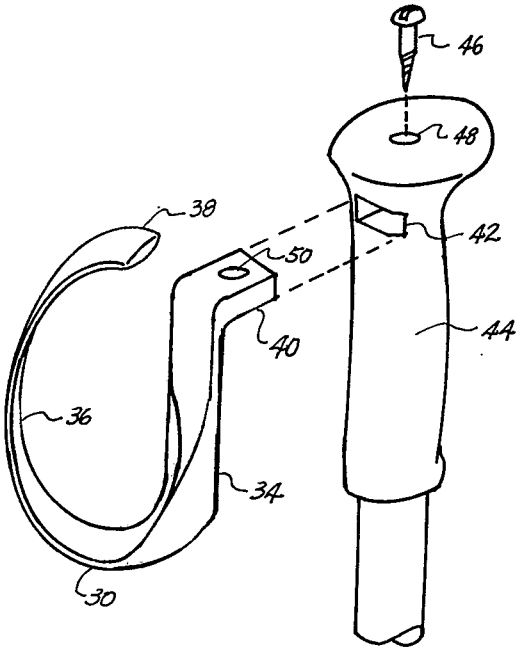
FIG. 9 is a perspective view of a second embodiment of the invention.
Figure 10:
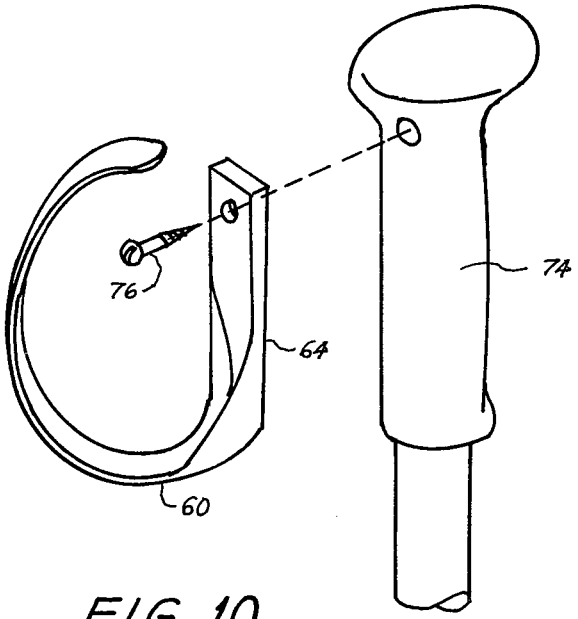
FIG. 10 is a perspective view of a third embodiment of this invention.

FIGS. 9 and 10 show two alternative embodiments of this invention. In FIG. 9 a two piece molded structure is shown in which a seperate hand encircling loop 30 is shown molded from a suitable elastomeric material. Loop 30 has a downwardly depending leg 34, hand encircling portion 36, upper end 38, and a pole engaging portion 40, which is formed at substantially right angles to the downwardly depending leg 34. Pole engaging portion 40 fits in slot 42 in grip 44 and is fastened into place by fastener 46 which is inserted downwardly through axial hole 48 into aperture 50 and grip engaging portion 40. Fastener 46 which may be a screw, rivet or other type of fastener, is tightened into its operative position holding the seperate loop 30 in position much like the apparatus shown in FIG. 1. The embodiment shown in FIG. 9 is preferably used in instances when it is advantageous to produce a grip and loop having differing elastomeric properties.

Another alternative embodiment is shown in FIG. 10. This embodiment is much like the apparatus of FIG. 9, however, the grip engaging portion of the loop 60 is formed as a part of the downwardly depending leg 64. The loop 60 is removably attached to a grip 74 by fastener 76.

Figure 2:
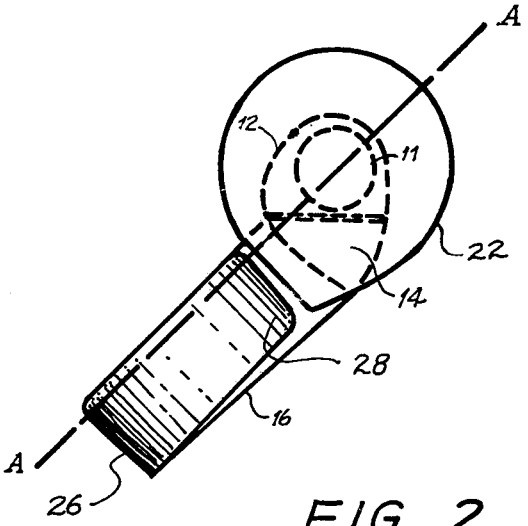
FIG. 2 is a top view of the apparatus in FIG. 1.

The ski pole grip and hand encircling loop taught herein may be advantageously molded in a relatively simple injection mold, best described with the reference to FIGS. 2, 3 and 4. A mold is constructed having a parting line along plane A—A. A flat insert is used to form the slot B—B as a part of the insert which forms the hole for the shaft. For injection molded elastomers, a least two sprue holes will be required, one to fill the hand encircling element 26 and one to fill the main body portion 12 of the grip. A flow passage is not desirable between the upper portion 28 of element 26 and the enlarged upper knob 22 since in the finished grip the element 26 is not attached to the knob 22 at the upper end of the grip. Thus if flow of the elastomer during molding is permitted between the upper end of the element 26 and knob 22 it will be necessary to sever element 26 at its upper end after molding.

This invention has been set forth in variant preferred embodiment form wherein a ski pole handle is shown having the desirable attribute of easy removal from the user's wrist while preventing accidental removal during normal operation all without the disadvantages of prior art ski grips using leather wrist encircling straps. While the invention has been set forth in preferred embodiment form, it is to be understood that changes and variation may be made without departing from the spirit and scope of the invention all as defined in the appended claims.

I claim:

1. A ski pole grip axially engaging the upper portion of a ski pole, said grip having a length in excess of the width of the user's hand, said grip comprising:

an upper enlarged head portion;

a body member adapted to be grasped by the user; and, a hand encircling loop means flexibly attached at one end thereof to said body adjacent said enlarged portion and depending downwardly therefrom, one portion thereof lying adjacent and substantially parallel to said body and being progressively thickened toward the bottom thereof to increase the rigidity of said one portion and support the heel of the user's hand, said hand encircling loop means including a second portion extending upwardly across the back of the user's hand to a distal end positioned adjacent but not connected to said enlarged portion of said body, said loop being flexible, resilient and movable away from said enlarged portion so as to release from user's hand, whereby axial forces are transmitted to the heel of the user's hand.

2. A ski pole grip as claimed in claim 1 in which said hand encircling loop is removably attached to said body.

3. The ski pole grip of claim 1 wherein said body is curved to conform to the natural curvature of the hand.

4. The ski pole grip of claim 2 wherein said hand encircling loop is attached to said body with an axially positioned fastener.

5. The ski pole grip of claim 2 wherein said hand encircling loop is attached to said body with a fastener positioned perpendicular to the axis of said body.

6. The ski pole for alpine type skiing having a grip body portion at one end of said pole, the improvement therein comprising:

a resilient hand encircling loop means attached at one downwardly within the palm of the user's hand, then beneath the heel of the user's hand in a force-transmitting relationship and extending upwardly across the back of the user's hand to a distal portion positioned adjacent, but not connected to said grip body portion; and, a hinge means interconnecting said body portion and said loop means, said loop means having a downwardly depending leg attached at said hinge means normally positioned adjacent to and substantially parallel to said body and pivotable away therefrom to permit forward reach with a ski pole attached to said grip, said depending leg further positioned within the normal grasp of the user of the ski pole and being progressively thickened to the area beneath the heel of the user's hand to increase the rigidity thereof.

7. The pole of claim 6 wherein said resilient hand encircling loop means is removably attached to said pole.

8. The pole of claim 6 further comprising an enlarged knob at the upper end of said grip body portion and wherein said loop means further includes an element extending outwardly and upwardly from said downwardly leg, the distal portion thereof being adjacent said enlarged knob.

* * * * *

UNITED STATES PATENT AND TRADEMARK OFFICE

CERTIFICATE OF CORRECTION

PATENT NO. : 4,232,875

DATED : November 11, 1980

INVENTOR(S) : Garry W. Klees

It is certified that error appears in the above-identified patent and that said Letters Patent are hereby corrected as shown below:

Claim 6 - the following full line has been omitted between lines 7 and 8; Column 5

"end to said grip body portion, said loop means extending"

Signed and Sealed this

*Thirteenth* Day of *January 1981*

[SEAL]

*Attest:*

SIDNEY A. DIAMOND

*Attesting Officer*

*Commissioner of Patents and Trademarks*